US005404600A

United States Patent [19]

DeMars

[11] Patent Number: 5,404,600

[45] Date of Patent: Apr. 11, 1995

[54] COMBINATION SLEEPING/CARRY BAG

[76] Inventor: Robert A. DeMars, 5000 N. Parkway Calabasas - Ste 233, Calabasas, Calif. 91302

[21] Appl. No.: 138,199

[22] Filed: Oct. 20, 1993

[51] Int. Cl.[6] ..... A47G 9/08

[52] U.S. Cl. ..... 5/413; 5/420

[58] Field of Search ..... 5/420, 413, 417; 190/107, 112, 117; 150/107

[56] References Cited

U.S. PATENT DOCUMENTS

| | | | |
|---|---|---|---|
| 748,288 | 12/1903 | Klein . | |
| 1,356,593 | 10/1920 | Behiker | 5/420 |
| 2,157,280 | 5/1939 | Butman . | |
| 2,788,533 | 4/1957 | Bornstein | 5/420 |
| 4,123,809 | 11/1978 | Pugh | 5/420 |
| 4,183,111 | 1/1980 | Zahavkochav | 5/413 |
| 4,197,891 | 4/1980 | Comollo | 150/12 |
| 4,375,111 | 3/1983 | Hall | 5/420 |
| 4,723,300 | 2/1988 | Aranow | 383/4 |
| 4,884,303 | 12/1989 | Scherer | 5/413 |
| 4,886,150 | 12/1989 | Fitzsimmons | 5/420 |
| 4,967,428 | 11/1990 | Browder | 5/420 |
| 4,991,245 | 2/1991 | Franco | 5/419 |
| 5,048,975 | 9/1991 | Holbrook | 383/4 |
| 5,099,530 | 3/1992 | Scott | 5/420 |
| 5,103,515 | 4/1992 | Bird | 5/420 |
| 5,110,219 | 5/1992 | Lopes | 383/4 |
| 5,210,891 | 5/1993 | Avital et al. | 5/420 |
| 5,285,833 | 2/1994 | Haxby | 150/107 |

*Primary Examiner*—Michael J. Milano
*Attorney, Agent, or Firm*—Jack C. Munro

[57] ABSTRACT

A multipurpose fabric device which is locatable in either an extended position or a retracted position. When in the extended position, the device becomes a conventional sleeping bag and when in the retracted position, the device functions as a carry bag. The carry bag is to be carried by a shoulder strap by a human. The carry bag also includes a plurality of article storing compartments. The device also includes a pillow that is to be used when the device is in the sleeping bag position.

6 Claims, 2 Drawing Sheets

COMBINATION SLEEPING/CARRY BAG

BACKGROUND OF THE INVENTION

1. Field of the Invention

The field of this invention relates to a sleeping bag for humans and more particularly to a sleeping bag for humans which can be converted into a tote bag or carry bag for small articles.

2. Description of the Prior Art

Sleeping bags are in exceedingly common usage by both children and adults. Sleeping bags are used in an outdoor environment when people are camping. Sleeping bags are also used in indoor environments such as when children congregate at slumber parties or just when a single child may sleep over at another child's house. The normal procedure is for the user to cart the sleeping bag to the location to be used. Generally additional paraphernalia is required such as toiletries and additional clothing which also must be carried. It is common for these additional items to be somehow carried such as within a separate carry bag.

It would be desirable if the sleeping bag could somehow be constructed to function also as a carry bag so that the additional items of paraphernalia could be carried within the sleeping bag thereby eliminating the use of the separate tote bag. Prior to the present invention it has not been known to construct a sleeping bag to also function as a carry bag when it is not being used as a sleeping bag.

SUMMARY OF THE INVENTION

The subject matter of this invention is directed to a multipurpose device which is capable of being located in an extended position and also capable of being located in a retracted position. When in the extended position the device looks and functions as a conventional sleeping bag. When in the retracted position the device functions as a carry bag or tote bag. The device of this invention is to be constructed almost entirely of a fabric or a fabric-like material. The device includes a main body which includes an internal compartment and with the main body stretched out, the human user is to be locatable within the internal compartment of the main body. The head of the human user is to extend exteriorly of the internal compartment and is to be locatable on a pillow which is attached to the main body. During times it is not being used as a sleeping bag, the main body is to be folded into three overlapping sections which happen to be about the same size as the pillow. The overlapping sections are to be secured together with a shoulder strap being mounted across the sides of the main body in the area of the access opening into the internal chamber. The shoulder strap can then be utilized by a human user to affect carrying of the now produced carry bag with there being produced a plurality of separate article storing compartments in conjunction with the device either within the internal chamber or in the areas provided between the overlapped sections. The shoulder strap is to be movable to a separate position alongside of the main body when the device is being used as a sleeping bag.

The primary objective of the present invention is to construct a carry bag which can be transformed into a sleeping bag.

Another objective of the present invention is to construct a combination sleeping bag and carry bag which can be quickly and easily moved by even an unskilled individual between the sleeping bag position and the carry bag position and vice versa.

Another objective of the present invention is to construct a combination sleeping bag and carry bag which can be manufactured at a reasonable cost and therefore sold to the ultimate consumer at a reasonable cost.

DETAILED DESCRIPTION OF THE SHOWN EMBODIMENT

Figure 2:
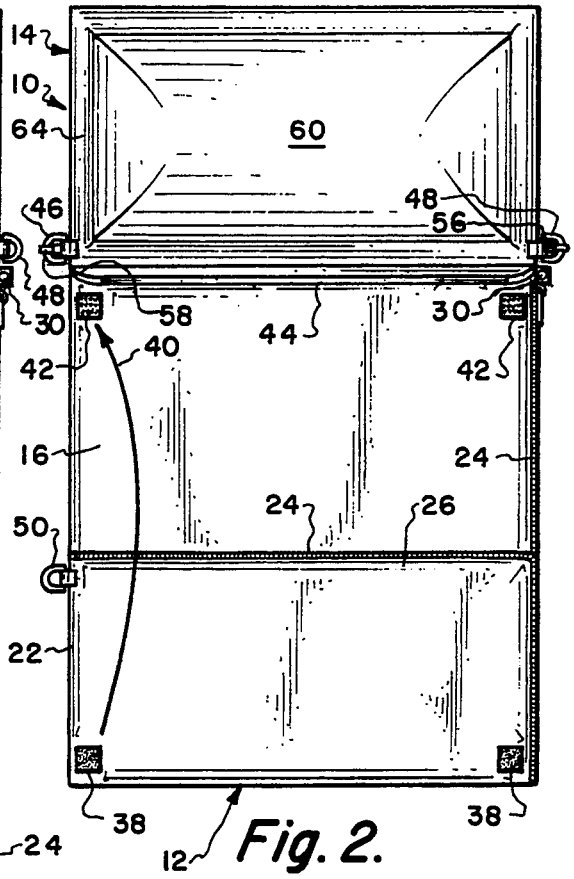
FIG. 2 is a view similar to FIG. 1 but showing the initial folding step toward moving of the sleeping bag to the carry bag position.
Figure 4:
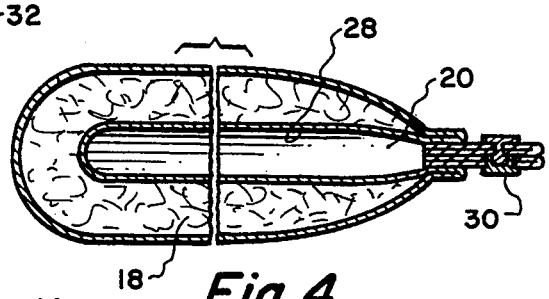
FIG. 4 is a cross-sectional view through the access opening area into the internal chamber of the sleeping bag taken along line 4—4 of FIG. 3.
Figure 3:
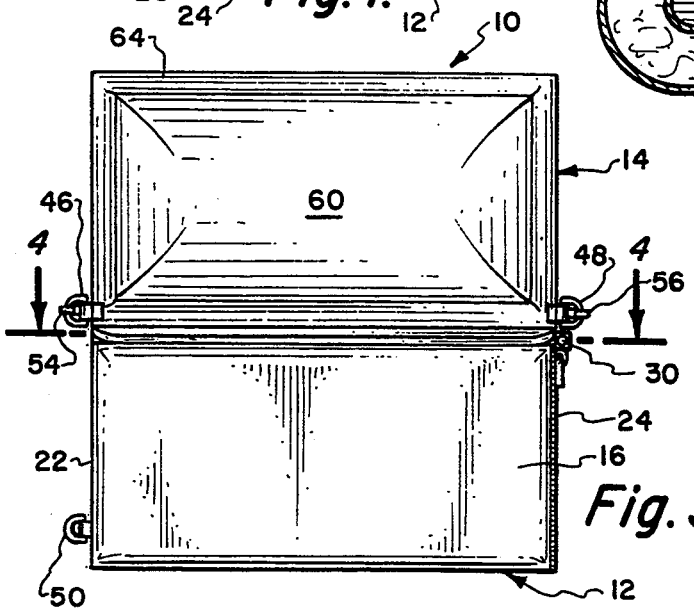
FIG. 3 is a view similar to FIG. 1 but showing the second folding step required to locate the sleeping bag to be a carry bag.

Referring in particular to the drawings, there is shown the structure 10 of this invention which is composed generally of a fabric main body 12 and a pillow 14. The main body 12 is constructed of a sheet material fabric outer layer 16 which encases a resilient padding 18. The padding 18 could comprise a plastic foam or could comprise an animal wool product. The main body 12 defines an internal chamber 20 which encases the interior surface of the padding 18. When observing FIGS. 1 to 3 of the drawings, the left side edge 22 is closed but there is a side opening formed within the right side edge which is closable by means of a zipper 24. The zipper 24 is of sufficient length as to also close the end wall 26. It is to be noted that the main body 12 is a basically rectangular shape with the end wall 26 being located parallel to the access opening 28 into the internal chamber 20. Typical material for the sheet material 16 would be a cotton or synthetic fabric.

The side wall of the main body 12, which has a zipper 24, includes a snap fastener 30. The function of the snap fastener 30 is to secure together the exterior layers of the sheet material 16 to prevent accidental opening of the zipper 24 when the structure 10 is being used as a carry bag. This will permit articles (not shown) to be stored within the internal chamber 20 by being placed through the access opening 28 and these articles will remain confined within the internal chamber 20 and not be able to be accidentally dislodged therefrom.

On the top surface of the main body 12 there are located a pair of fastening pads 32 directly adjacent the end wall 26. Also mounted on the top surface of the main body 12, a distance about two-thirds the length of the main body 12 from the end wall 26, are a pair of fastening pads 34. The pads 34 are to comprise, for example, a mass of tiny eyelets and the pads 32 will comprise as mass of tiny hooks. The main body 12 is to be foldable into thirds which will result in one pad 32 abutting against one pad 34 and the remaining pad 32 coming into contact with the remaining pad 34. One-third of the main body 12 has been folded over upon itself in an overlapping relationship and this position is shown in FIG. 2 of the drawing. This folding procedure is depicted by arrow 36 in FIG. 1.

Strategically placed on the bottom surface of the main body 12 are a pair of pads 38 which are similar to pads 32. At this time the main body 12 is to again be folded over upon itself in the direction depicted by arrow 40 decreasing the overall length of the main body 12 to one-third its original length. In essence the main body 12 is now composed of three sections located in an overlapping arrangement. In this particular position a pad 38 is to connect with an eyelet pad 42 with the remaining pad 38 connecting with a separate eyelet pad 42. Both the eyelet pads 42 are mounted on the top surface of the main body 12 located directly adjacent the end wall 44. The access opening 28 is formed at the end wall 44. There are formed open-ended pockets 25 and 27 between the overlapped sections of the main body 12.

Mounted on the pillow 14 at the side wall 12 directly adjacent the access opening 28 is an eyelet ring 46. A similar eyelet ring 48 is mounted on the opposite side wall of the pillow 14 in alignment with the zipper 24. A still identical eyelet ring 50 is mounted on the side wall 12 directly adjacent the end wall 26. A shoulder strap assembly 52 is adjustable in length by a buckle 54. One end of the strap assembly 52 is connected to a snap hook 56 with the other end of the strap assembly 52 being connected to a snap hook 58.

Figure 5:
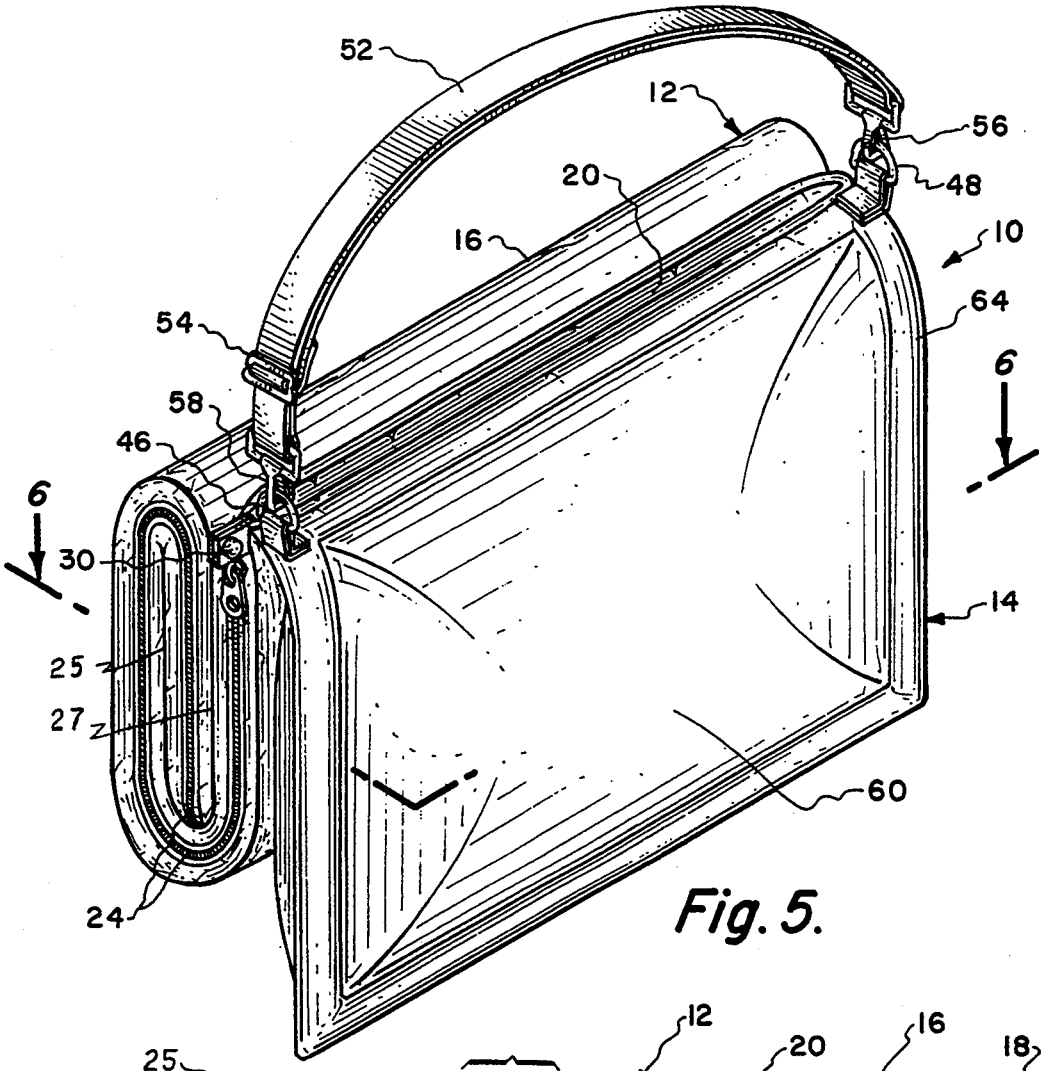
FIG. 5 is an isometric view of the structure of this invention showing the structure in the carry bag position.
Figure 6:
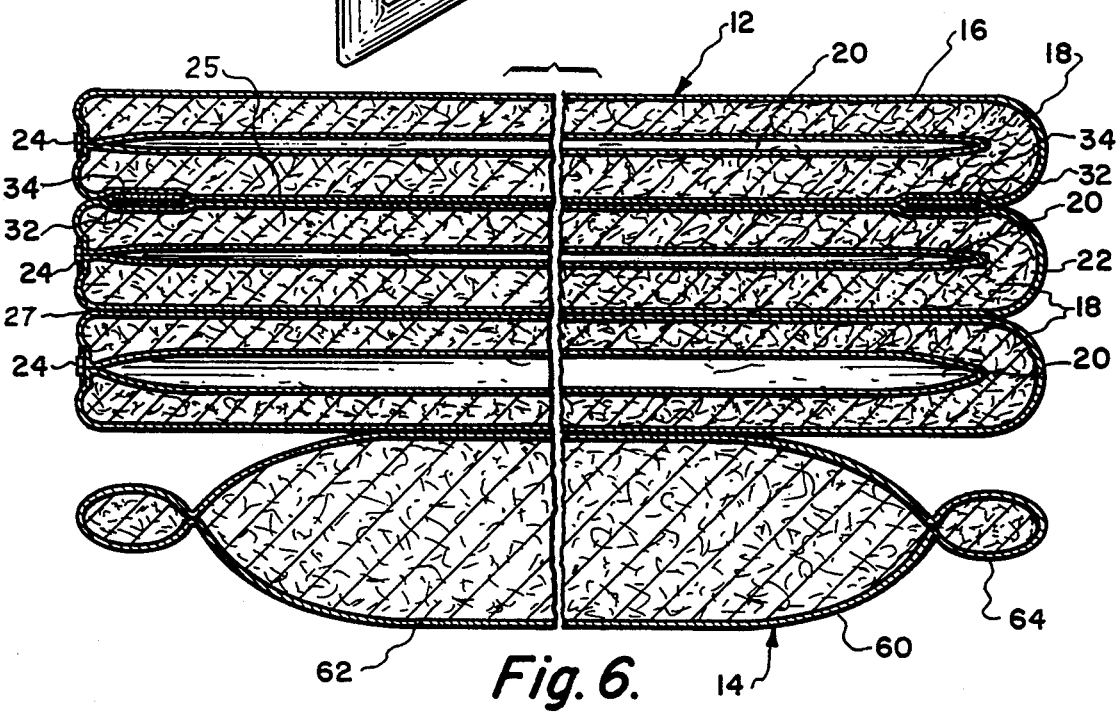
FIG. 6 is a cross-sectional view taken along line 6—6 of FIG. 5.

In order to carry the structure 10 of this invention as a carry bag, the snap hook 58 engages with the eyelet ring 46 with the snap hook 56 engaging with the eyelet ring 48. This position is clearly shown in FIG. 5 of the drawings. When lifting motion is applied to the structure 10, the pillow 14 will automatically move in juxtaposition to the three overlapped layers of the main body 12.

Figure 1:
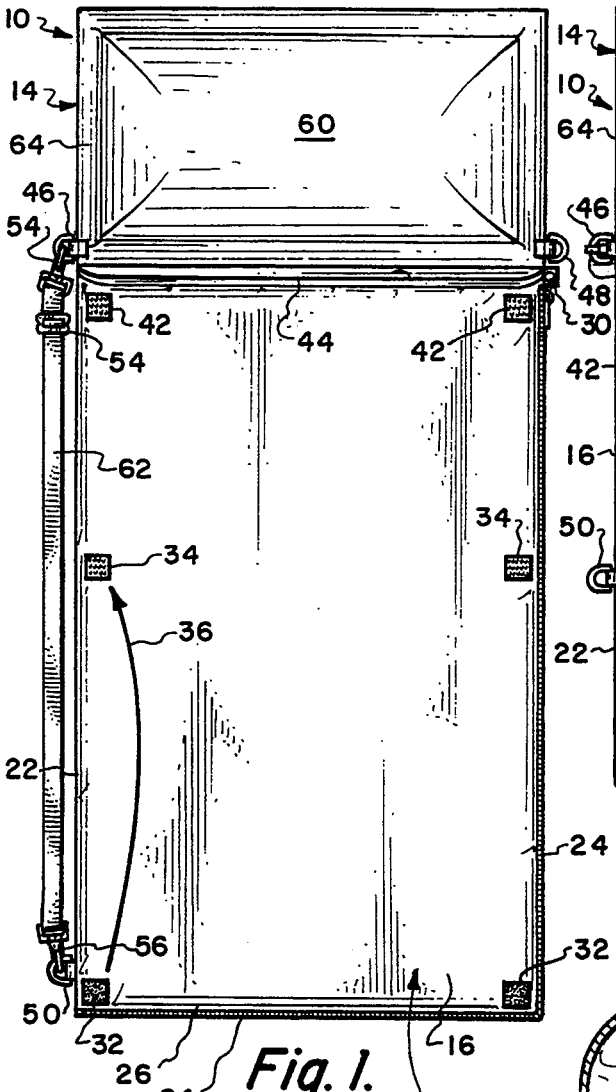
FIG. 1 is a top plan view of the combination of sleeping bag and carry bag of this invention showing the structure in the sleeping bag position.

In order to move the strap assembly 52 out of the way when the structure 10 is in the extended position shown in FIG. 1, the snap hook 56 is to be disengaged from the eyelet ring 48 and moved to engage with the eyelet ring 50. This locates the strap assembly exteriorly of the main body 12 and alongside the side wall 22.

The pillow 14 is to be constructed of an exterior sheet material fabric layer 60 within which is encased a quantity of padding 62. Padding 62 is basically similar to the padding 18. The pillow 14 includes a peripheral padded section 64 which helps to enlarge the center section of the pillow 14.

What is claimed is:

1. A combination sleeping/carry bag comprising:

a main body formed of a soft flexible sheet material, said main body being locatable in an extended position and a retracted position, said main body having an internal chamber, an access opening providing entry into said internal chamber, said internal chamber adapted to have a human be locatable therein when said main body is in said extended position with the head of the human protruding exteriorly of said access opening;

a pillow attached to said main body at said access opening, said pillow being adapted to come into contact with the head of the human when a human is located within said internal chamber, with said main body being foldable into a three layer overlapping arrangement which comprises said retracted position there is a securing means connecting with said main body, said securing means to hold said main body in said overlapping arrangement, with said main body in said retracted position said pillow being located in juxtaposition with said three layer overlapping arrangement, said main body forming a plurality of separate article storing compartments when said main body is in said retracted position;

a shoulder strap connected to said main body at said access opening, said shoulder strap to extend across said access opening when said main body is in said retracted position; and when said main body is in said extended position said shoulder strap is to be moved to occupy a position exteriorly of and alongside said main body.

2. A combination sleeping/carry bag comprising:

a main body formed of a soft flexible sheet material, said main body being locatable in an extended position and a retracted position, said main body having an internal chamber, an access opening providing entry into said internal chamber, said internal chamber adapted to have a human be locatable therein when said main body is in said extended position with the head of the human protruding exteriorly of said access opening;

a pillow attached to said main body at said access opening, said pillow being adapted to come into contact with the head of the human when a human is located within said internal chamber, with said main body being foldable into a three layer overlapping arrangement which comprises said retracted position there is a securing means connecting with said main body, said securing means to hold said main body in said overlapping arrangement, with said main body in said retracted position said pillow being located in juxtaposition with said three layer overlapping arrangement, said main body forming a plurality of separate article storing compartments when said main body is in said retracted position;

a shoulder strap connected to said main body at said access opening, said shoulder strap to extend across said access opening when said main body is in said retracted position; and said main body being rectangular forming a pair of end walls and a pair of side walls, said access opening being locatable at one said end wall with the other said end wall including a zipper fastener substantially along the entire length of said other end wall, one said side wall including a zipper fastener substantially along the entire length of said side wall.

3. The combination as defined in claim 2 wherein:

said side wall which includes said zipper fastener also including a separate fastener which when secured will prevent undesirable movement of said zipper fastener from a closed position toward an open position.

4. The combination as defined in claim 3 wherein:

said three layer overlapping arrangement comprising three sections of said main body of substantially equal size located in juxtaposition, said pillow being substantially the same size as each said section.

5. The combination as defined in claim 4 wherein:

at least one of said article storage compartments being open ended.

6. The combination as defined in claim 5 wherein:

when said main body is in said extended position said shoulder strap is to be moved to occupy a position exteriorly of and alongside said main body.

* * * * *